United States Patent [19]

Boris, Jr.

[11] Patent Number: 5,076,081

[45] Date of Patent: Dec. 31, 1991

[54] KEY FOR INTERCHANGABLE CORE LOCK

[75] Inventor: Frederick Boris, Jr., Meriden, Conn.

[73] Assignee: Lori Corporation, Southington, Conn.

[21] Appl. No.: 639,883

[22] Filed: Jan. 11, 1991

Related U.S. Application Data

[62] Division of Ser. No. 549,409, Jul. 6, 1990, Pat. No. 5,010,753.

[51] Int. Cl.[5] ..... E05B 19/08

[52] U.S. Cl. ..... 70/398; 70/409

[58] Field of Search ..... 70/388, 398, 414, 409, 70/395, 397, 411, 403, 404, 369, 371

[56] References Cited

U.S. PATENT DOCUMENTS

| | | | |
|---|---|---|---|
| 947,913 | 2/1910 | Jenkins | 70/398 |
| 977,181 | 11/1910 | Fremon | 70/398 |
| 1,974,953 | 9/1934 | Evans | 70/414 |
| 2,271,048 | 1/1942 | Spiro | 70/414 |
| 2,295,356 | 9/1942 | Rathbun | 70/414 |
| 3,557,584 | 1/1971 | Triglia | 70/388 X |
| 4,823,575 | 4/1989 | Florian et al. | 70/358 |
| 5,010,753 | 4/1991 | Boris, Jr. | 70/371 |
| 5,010,754 | 4/1991 | DeAngelo et al. | 70/395 X |

FOREIGN PATENT DOCUMENTS

| | | | |
|---|---|---|---|
| 394172 | 4/1924 | Fed. Rep. of Germany | 70/398 |
| 201896 | 3/1939 | Switzerland | 70/398 |

*Primary Examiner*—Lloyd A. Gall

*Attorney, Agent, or Firm*—Chilton, Alix & Van Kirk

[57] ABSTRACT

A rekeyable lock includes a false bible which houses a retainer pin, the retainer pin engaging the lock core. The lock core has a pin tumbler located to selectively engage the retainer pin so as to cause disengagement thereof from the core. The false bible is not physically attached to the core and is configured to match the operating environment.

5 Claims, 13 Drawing Sheets

KEY FOR INTERCHANGABLE CORE LOCK

This is a divisional of co-pending application Ser. No. 549,409, filed on July 6, 1990, now U.S. Pat. No. 5,010,753.

BACKGROUND OF THE INVENTION

1. Field of the Invention

The present invention relates to a key for use with an improved lock system, which system may easily be installed as a replacement for an existing lock, and especially to a key for a cylinder lock system having a readily replaceable core. Accordingly, the general objects of the present invention are to provide novel and improved apparatus of such character.

2. Description of the Prior Art

The present invention may be employed in virtually any key operated lock. The "re-keying" of a lock, i.e., the changing of the "core" therein, has previously often been a time-consuming task which required a degree of manual dexterity. For example, in the case of key-in-knob locks, such core replacement has often required the replacement of the knob and the altering of the lock system chassis. As a further deficiency of the prior art, locks sold as being capable of being recored with the use of a control key have often employed permutations on the key normally used for locking purposes to accomplish the core removal function. There has been a long-standing desire to enable the "re-keying" of a lock without the services of a mechanic and/or without the delay which might be incident for waiting for the arrival of a mechanic and/or in a manner which increases, rather than decreases, the security afforded by the lock.

SUMMARY OF THE INVENTION

The present invention overcomes the above-discussed and other deficiencies and disadvantages of the prior art by providing a special key for use with a cylinder-type lock which may be removed from its operating environment.

Apparatus with which the key of the present invention will be used includes a cylinder lock having a shell and a plug which is rotatable relative to the shell about an axis. The plug defines a keyway which extends axially thereof. The cylinder lock further includes a retainer pin tumbler receiving bore which extends through the shell and a retaining pin activating pin tumbler receiving bore which extends between said keyway and the outer circumference of the plug. The retainer and activating pin tumbler receiving bores have axes which are oriented generally transversely with respect to the axis of rotation of the plug, the axes of said retainer and activating pin tumbler receiving bores being non-aligned when the plug is in an unrotated state relative to the shell, said bores being positioned so as to be capable of being brought into alignment. The shell further has a non-linear groove which extends from the retainer pin tumbler receiving bore to a first end of the shell, said shell first end being disposed oppositely with respect to the entry end of the keyway. The plug and shell cooperate in the customary manner to define a plurality of locking pin tumbler receiving chambers, locking pin tumbler stacks being disposed in said locking pin tumbler receiving chambers and defining the bitting of the cylinder lock.

An activating pin is disposed in the activating pin tumbler receiving bore, the activating pin being movable along its receiving bore and being sized to at least in part be received in the retainer pin tumbler receiving bore. A housing which defines a retainer pin receiving chamber, the retainer pin receiving chamber being axially alignable with the retainer pin tumbler receiving bore in the shell is supported in juxtapositioned relationship to the shell. A reciprocal, resiliently biased retainer pin is located in the housing bore to normally engage the retainer pin tumbler receiving bore in the shell to thereby capture the cylinder lock against rotation relative to said housing. Insertion into the plug keyway of a control key having a bitting which engages the activating pin transversely repositions the inwardly disposed end of the retainer pin to the level of the intersection of the retainer pin tumbler receiving bore in the shell with the groove. Thus, once the activating and retaining pin bores in the plug and shell have been aligned, the cylinder lock may be separated from the chassis which supports the housing.

The key of the present invention, for use with a lock of the type described above, comprises a bow and a blade which longitudinally extends from the bow to a tip. The key blade is provided with bitting which is elongated so as to permit limited axial movement of the key after it has been inserted in a keyway of the lock. The blade is also provided, adjacent the tip thereof, with control biting which is operable only when the key is inserted into the keyway as far as permitted by the elongated bitting. The key is further characterized by a "projection" which extends outwardly from at least one of the edges of the blade adjacent to the junction of the blade and bow. This projection is defined by a pin which is resiliently biased toward the blade tip. The pin is shaped so that, as it is inserted into the keyway, it will cause a pin tumbler which it engages to move outwardly with respect to the axis of the lock cylinder. The pin is further shaped such that, during rotation, it will similarly impart movement to any pin tumbler which it engages. Thus, the pin is formed so as to have camming surfaces on at least two sides thereof.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DESCRIPTION OF THE DISCLOSED EMBODIMENT

Figure 1:
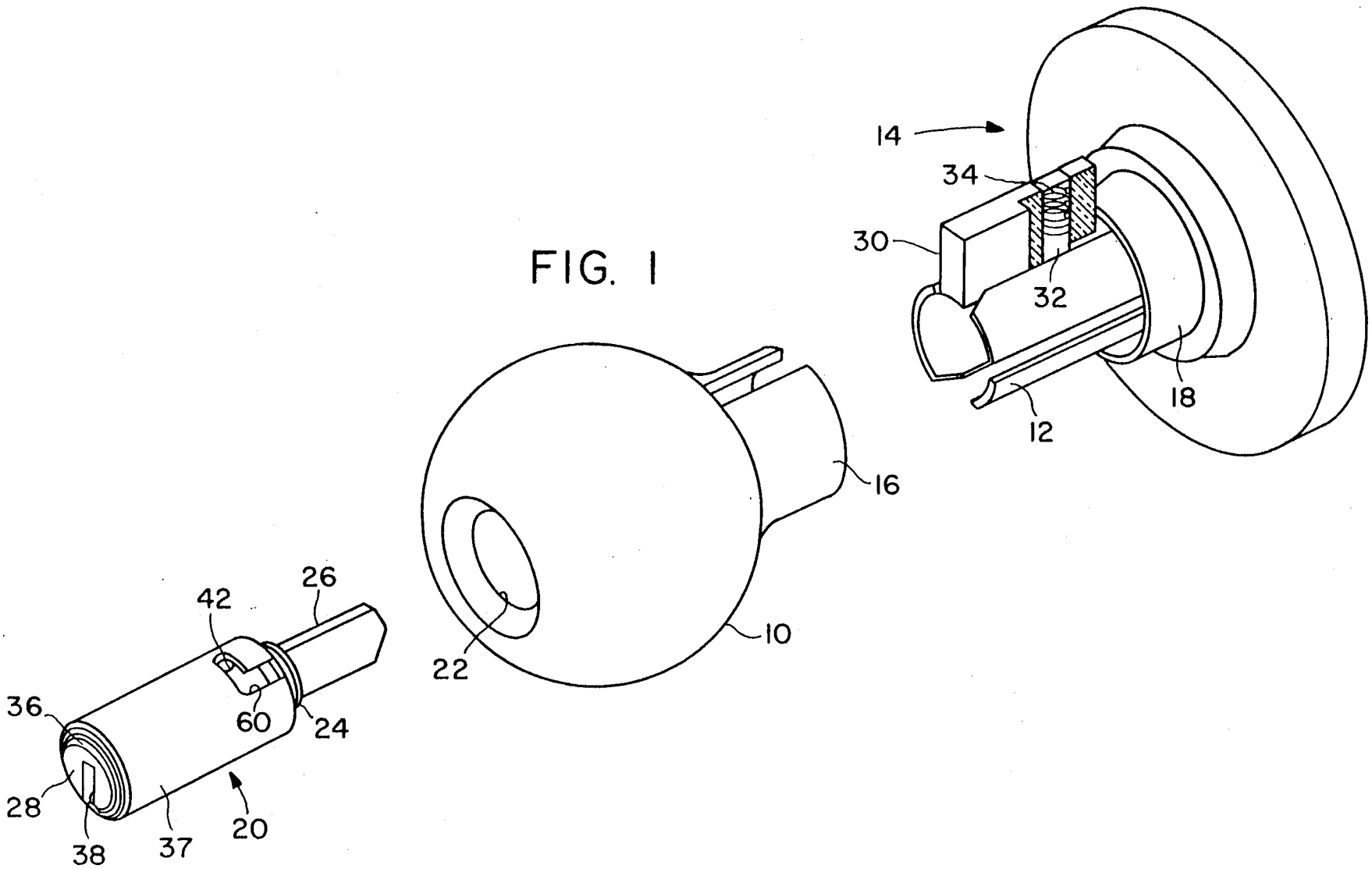
FIG. 1 is an exploded perspective view, partly in section, which depicts, in the environment of a knob set, a lock system of the general type with which the present invention may be employed.

With reference first to FIG. 1, a conventional knob set modified for use with the key, the present invention is shown in exploded perspective view and also partly in section. The knob set includes a conventional knob 10. Knob 10 receives a slotted spindle 12 which extends from a chassis, indicated generally at 14. When the knob set is fully assembled, the slotted tubular projection 16 of knob 10 will extend under the threaded bushing 18 on chassis 14, while spindle 12 extends through projection 16 and into knob 10. A cylinder-type lock, indicated generally at 20, is received in spindle 12, the front face of cylinder lock 20 being accessible via the opening 22 in knob 10 when the lock system is fully assembled. Cylinder lock 20 is provided with an adapter 24 and tail piece 26 which couple the rotatable plug 28 of the lock 20 to the bolt subassembly, not shown, which is mounted in the door. The adapter 24 and tail piece 26 may be varied to suit the operating environment in the manner disclosed in U.S. Pat. No. 4,672,828.

Figure 12:
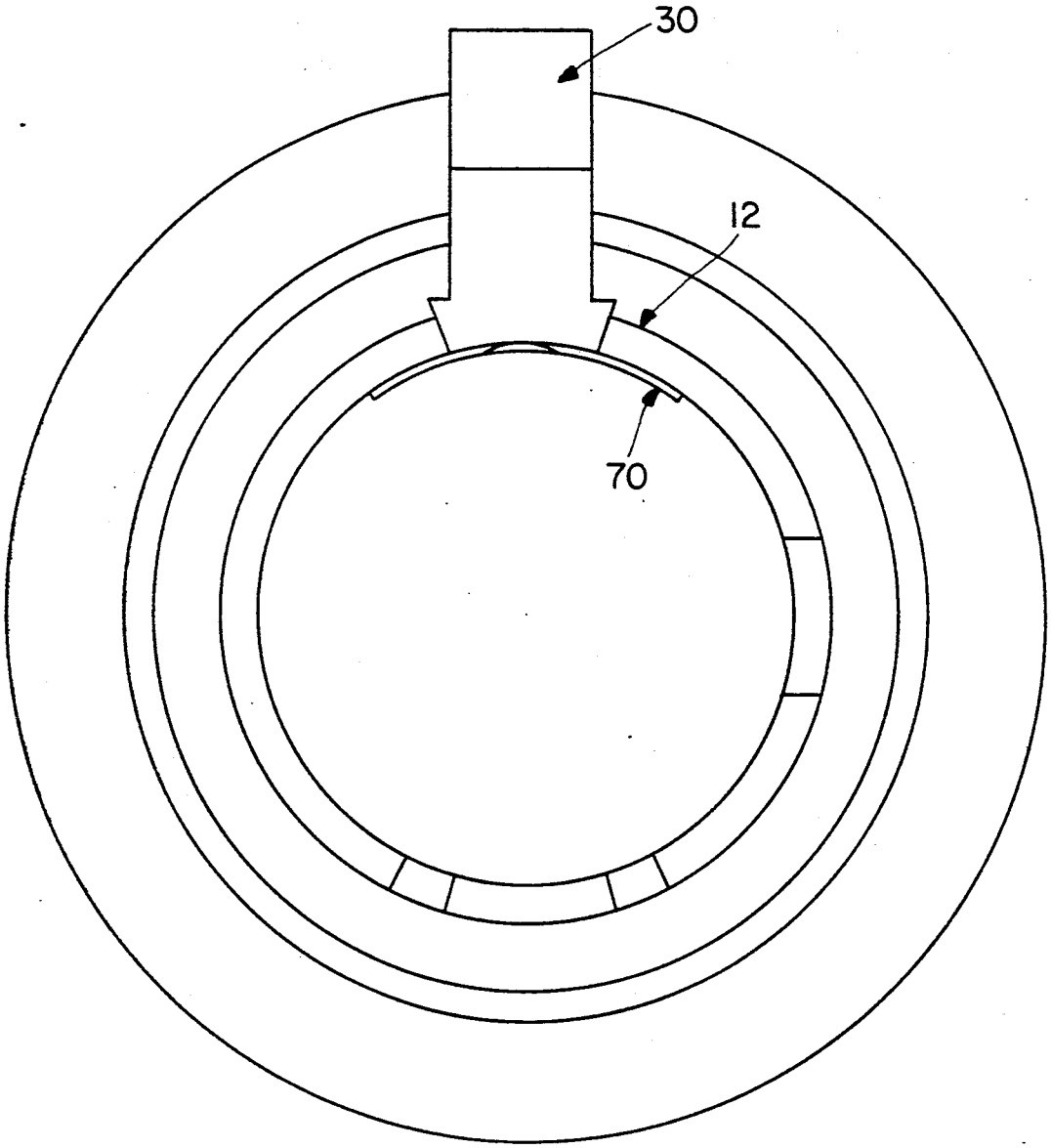
FIG. 12 is a view which depicts one possible way to mount the bible of a lock of the type depicted in FIG. 1 on the spindle of a knob set.

The lock system of FIG. 1 also includes a false "bible" 30 which is removably mounted on spindle 12 for example by means of the retainer flange 70 shown in FIG. 12. Bible 30 houses a driver/retainer pin 32 which is biased toward the axis of rotation of the plug 28 by a spring 34. The manner in which pin 32 in bible 30 cooperates with cylinder lock 20 will be described below.

Figure 2:
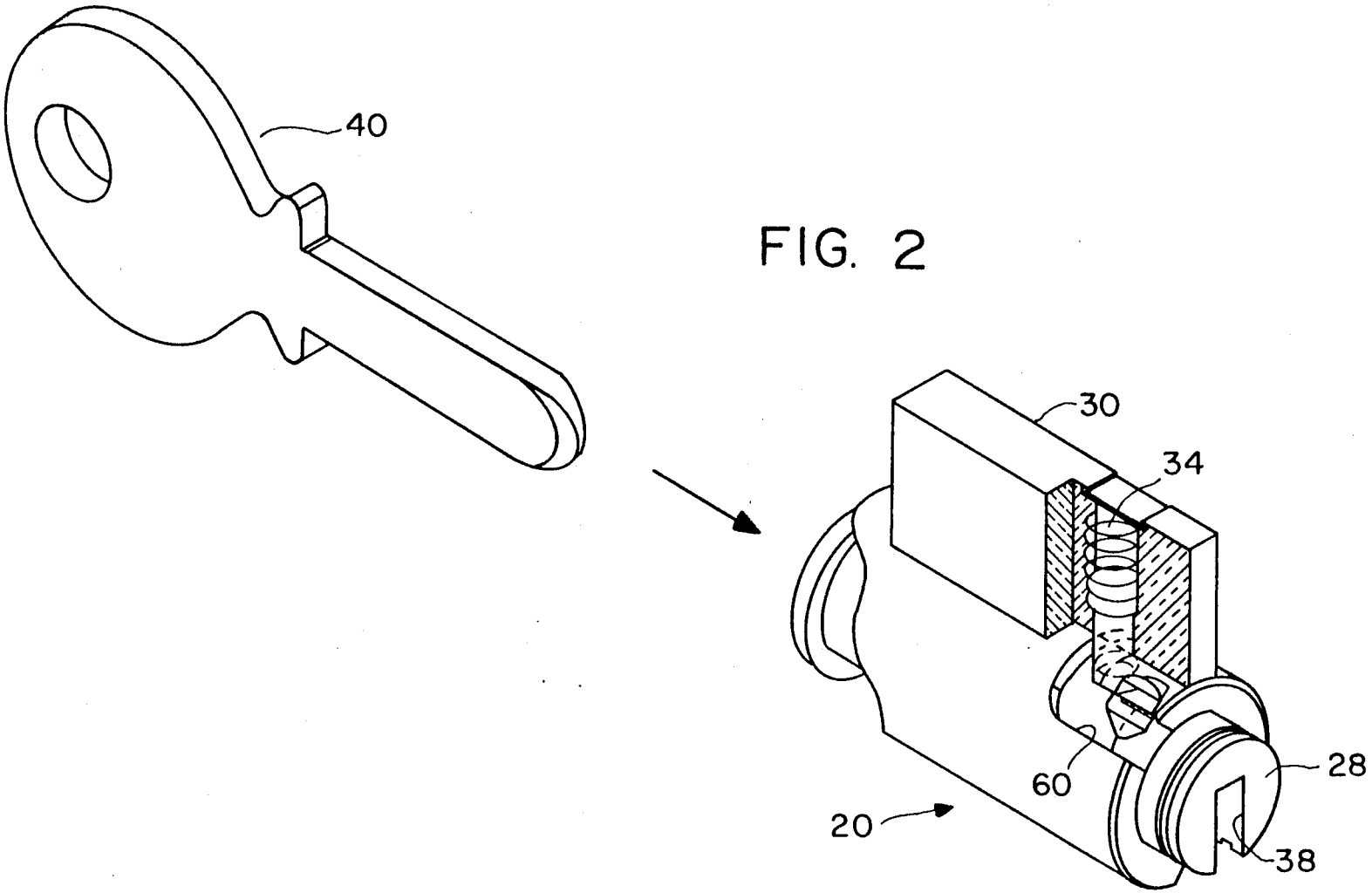
FIG. 2 is a partial perspective view, partly in section, depicting the lock system of FIG. 1.
Figure 13:
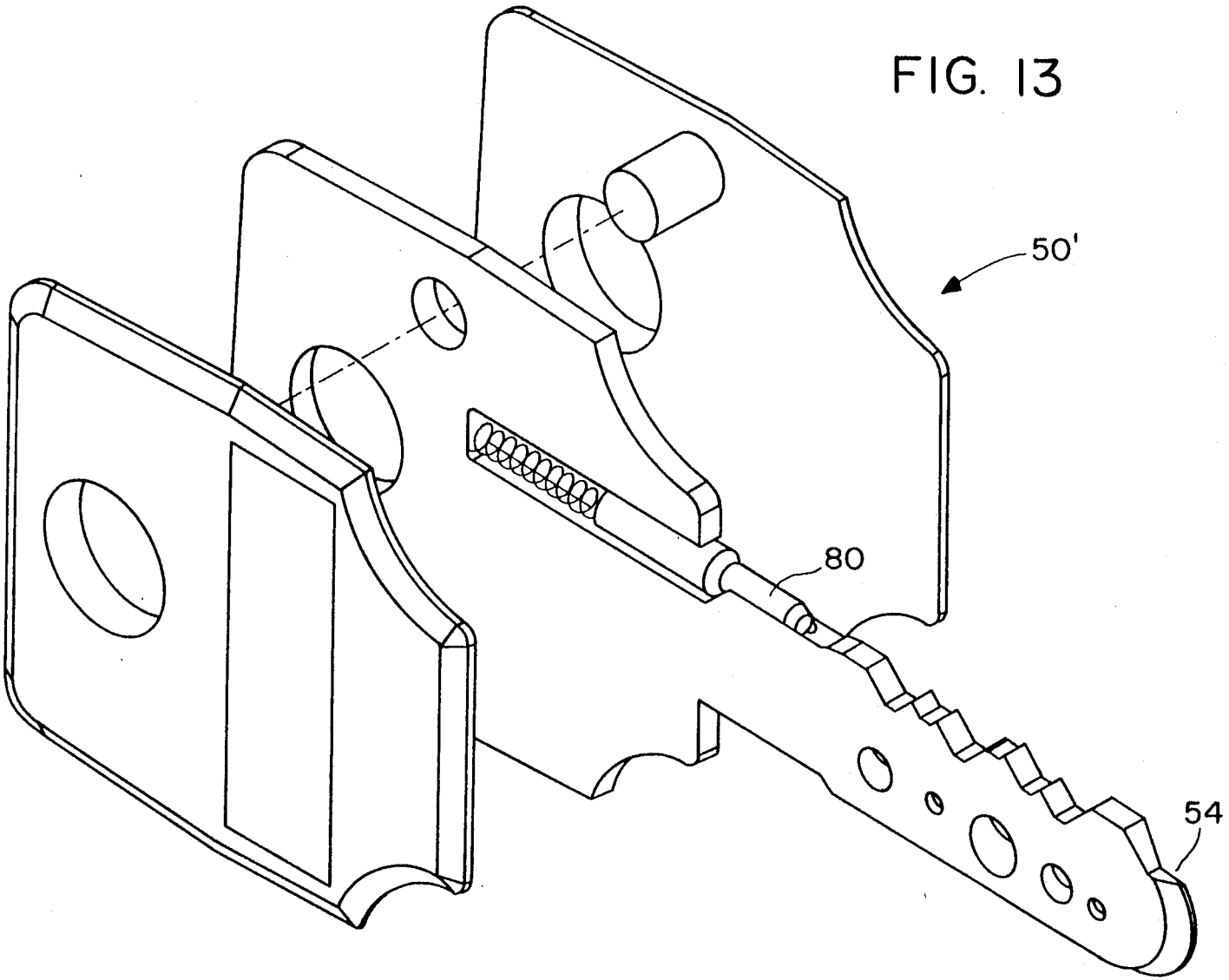
FIG. 13 is a perspective view, partly in section, showing a preferred embodiment of a key in accordance with the present invention which may be employed with certain locks which embody the apparatus depicted in FIGS. 1-12.

The cylinder lock 20 includes, in addition to plug 28, a shell 36 and an outer sleeve 37. A cylinder lock having such a plug, shell and sleeve may be seen from U.S. Pat. No. 4,823,575. The shell and plug are provided, in the conventional manner, with cooperating pin tumbler stacks located in chambers, not shown, which are aligned when the plug is in the unrotated condition relative to the shell. These pin tumbler receiving chambers intersect a keyway 38 which is formed in plug 28. The bottom pins of the pin tumbler stacks are, in the conventional manner, resiliently biased into the keyway and define the bitting of the lock. Insertion of a properly bitted key in the plug keyway will reposition the pin tumbler stacks such that a shear line defined by abutting faces of pins of each pin tumbler stack lies on the shear line 39 (FIG. 3) between the plug and shell and thus rotation of the plug relative to the shell is permitted. The bitting may be in the form of a serration, i.e., a saw tooth cut, in an edge of the key blade and/or in suitably sized, shaped and/or angled recesses. A key in accordance with the present invention and having both types of bitting is shown in FIG. 13. Another key is depicted in FIG. 2 without any bitting in the interest of facilitating understanding of the operation of the disclosed system.

Figure 3:
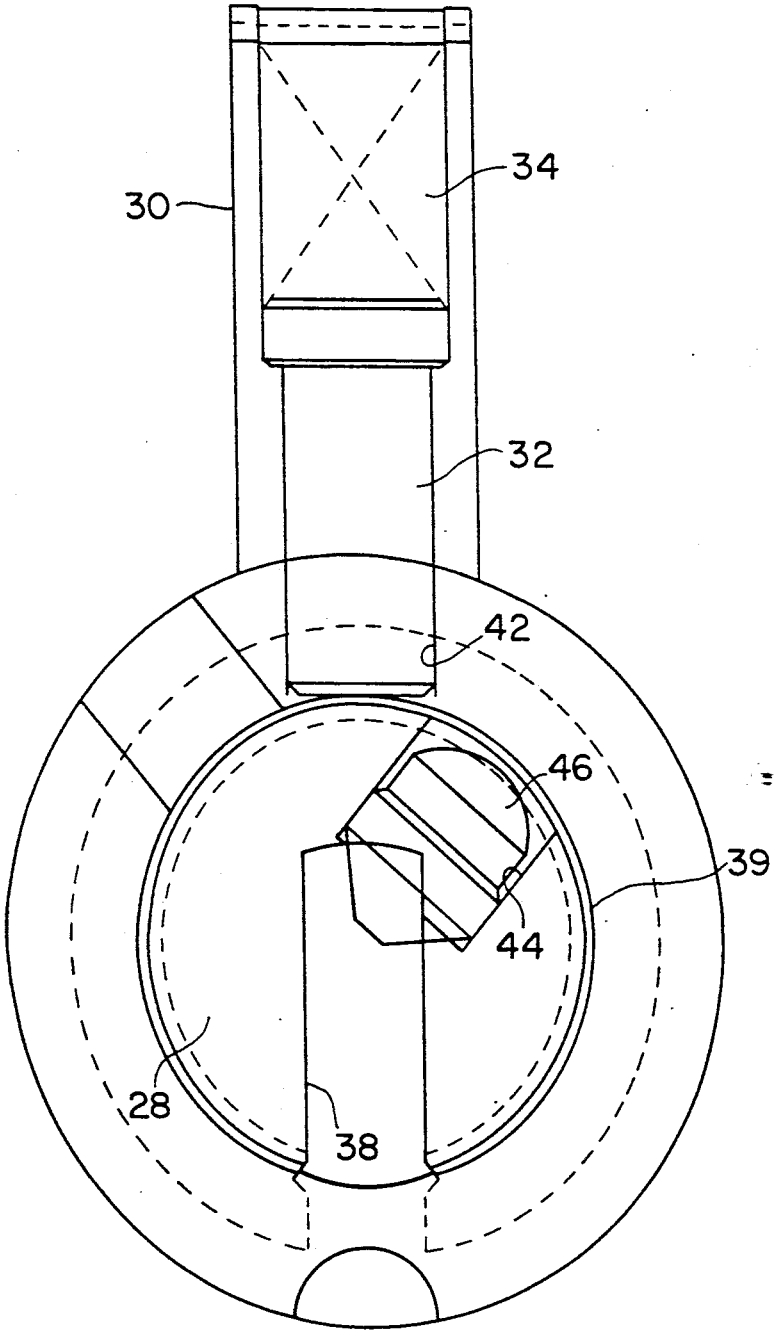
FIG. 3 is a schematic cross-sectional view through the lock of FIGS. 1 and 2.
Figure 4:
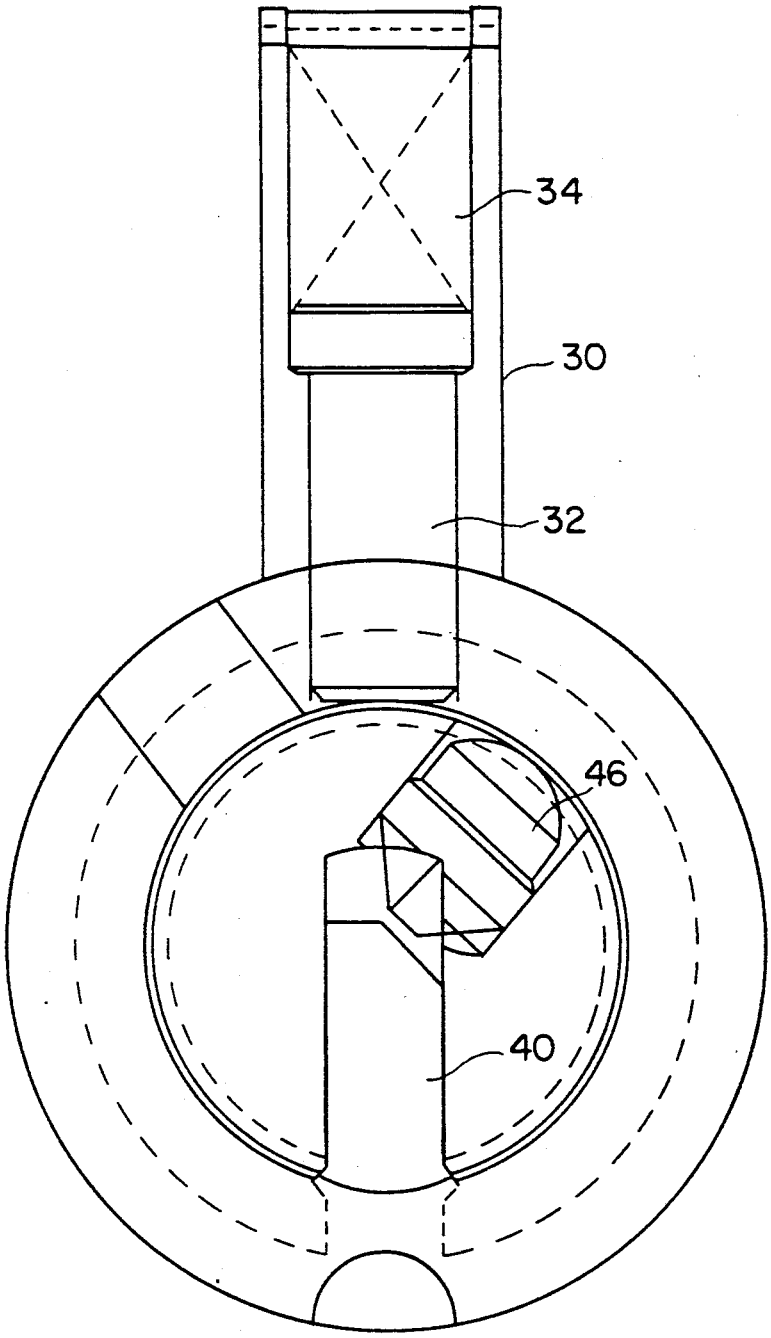
FIG. 4 is a view similar to FIG. 3 showing the lock with the key employed for normal operation inserted in the keyway.

The driver/retainer pin 32 located in bible 30 engages a retainer pin receiving bore, which may be seen at 42 in FIG. 1, which extends through sleeve 37 and shell 36. The plug 28, as may best be seen from FIG. 3, is provided with a retaining pin actuator tumbler receiving bore 44 which receives a bottom or actuating pin 46 which cooperates with driver/retainer pin 32 in the manner to be described below. With the plug 28 in the unrotated position relative to shell 36, the axis of bore 44 is angularly oriented with respect to the axis of bore 42, i.e., the driver/retainer pin 32 and bottom pin 46 are angularly offset with the plug unrotated relative to the shell. It should also be noted that bores 42 and 44, and thus the pin tumbler stack comprising driver retainer pin 32 and bottom pin 46, are positioned at a location along the keyway 38 which is disposed at a distance from the face of plug 28 which is greater than the length of the blade of the normal operating key 40. Accordingly, the use of bitting on the key which would normally be employed for locking purposes is not required for operation of the pin tumbler stack which includes retainer pin 32 and thus the number of key/lock permutations is not reduced by the inclusion of the recoring capability.

The driver/retainer pin 32 normally extends to the shear line 39 between plug 28 and shell 36 under the influence of biasing spring 34. Accordingly, the driver/-retainer pin 32 does not effect normal lock operation. Thus, a properly bitted normal operating key needs to reposition only the conventional pin tumblers to permit rotation of the plug relative to the shell. During such rotation, the cooperation between driver/retainer pin 32 and the bore 42 in shell 36 prevents rotation of the shell relative to the bible and thus relative to spindle 12.

Figure 5:
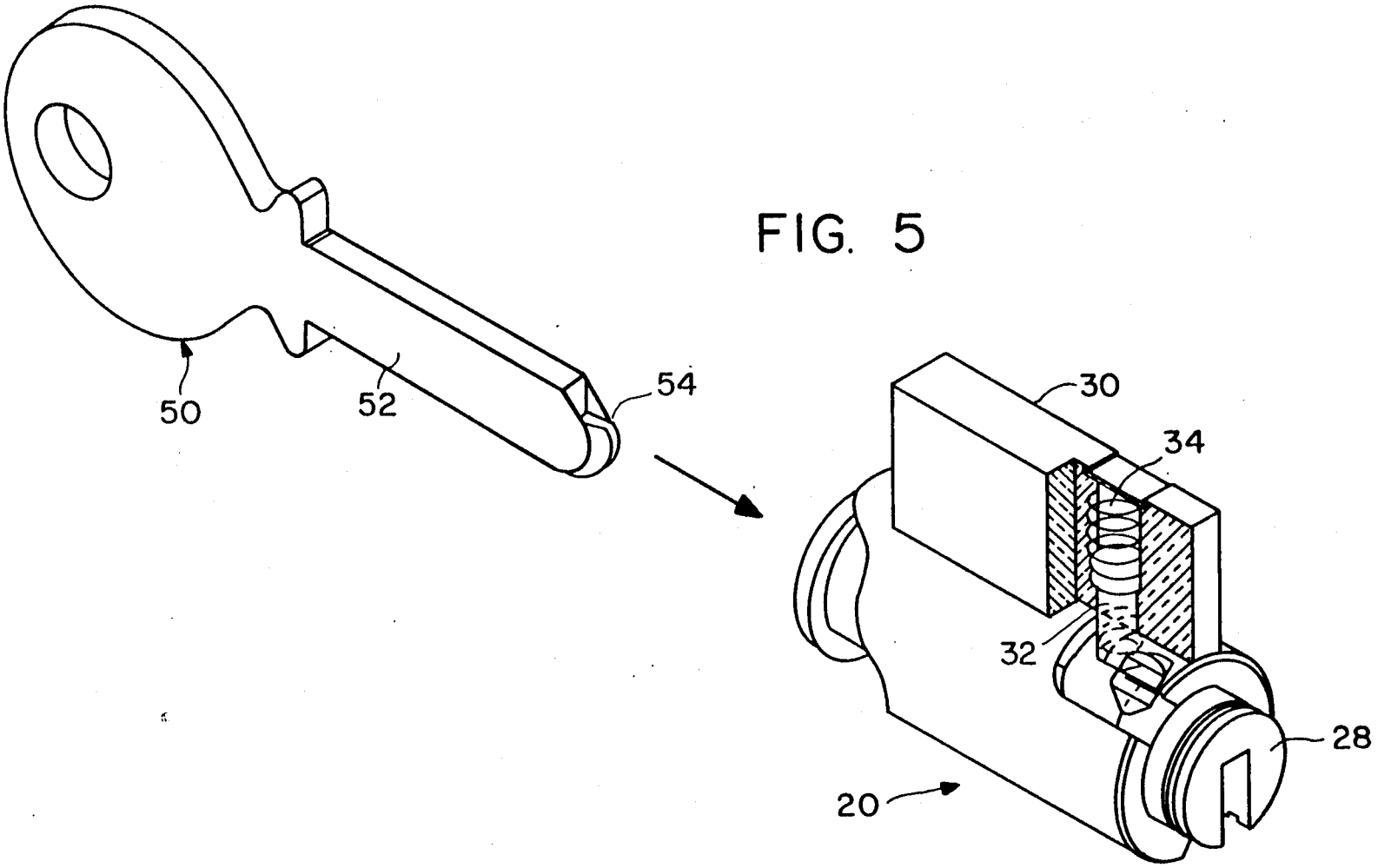
FIG. 5 is a view similar to FIG. 2, FIG. 5 schematically depicting a control key for the lock.
Figure 6:
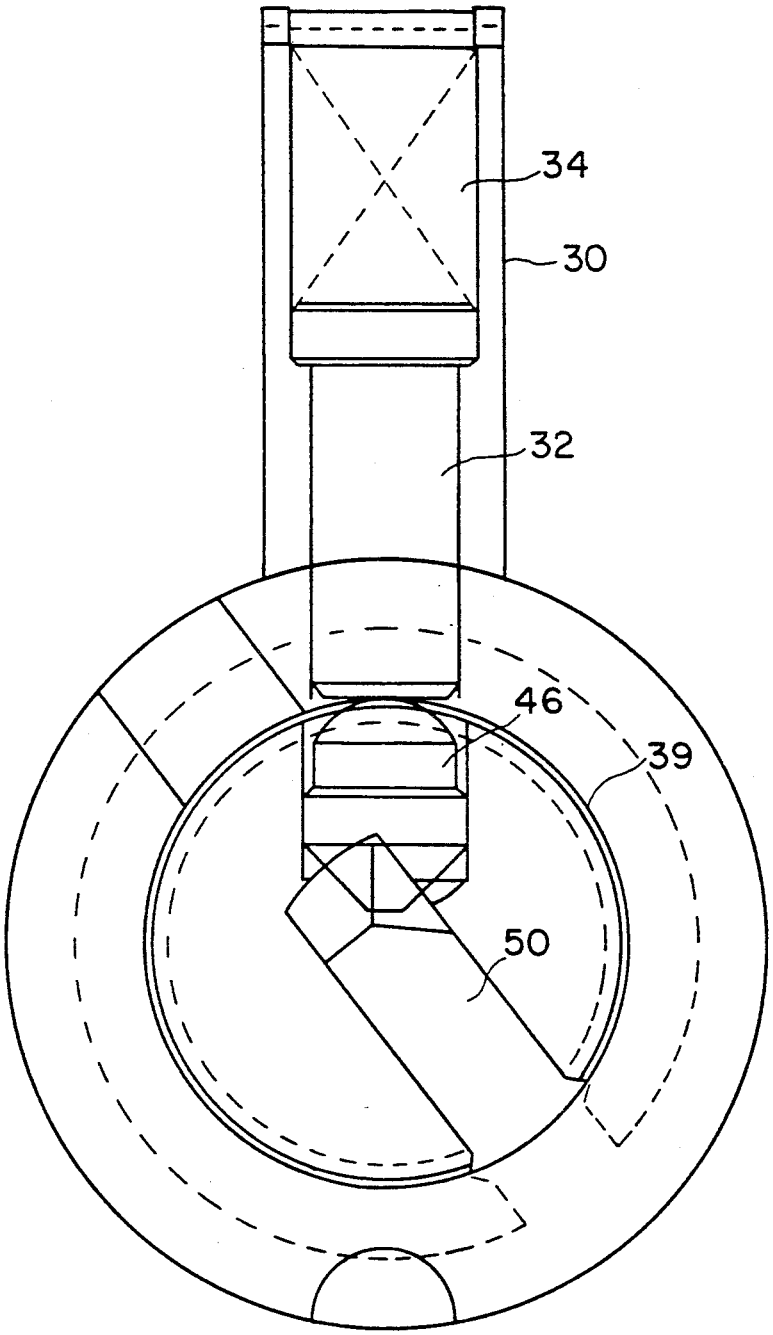
FIG. 6 is a view similar to FIGS. 3 and 4 showing the lock with the control key inserted and rotated to an activation position.
Figure 7:
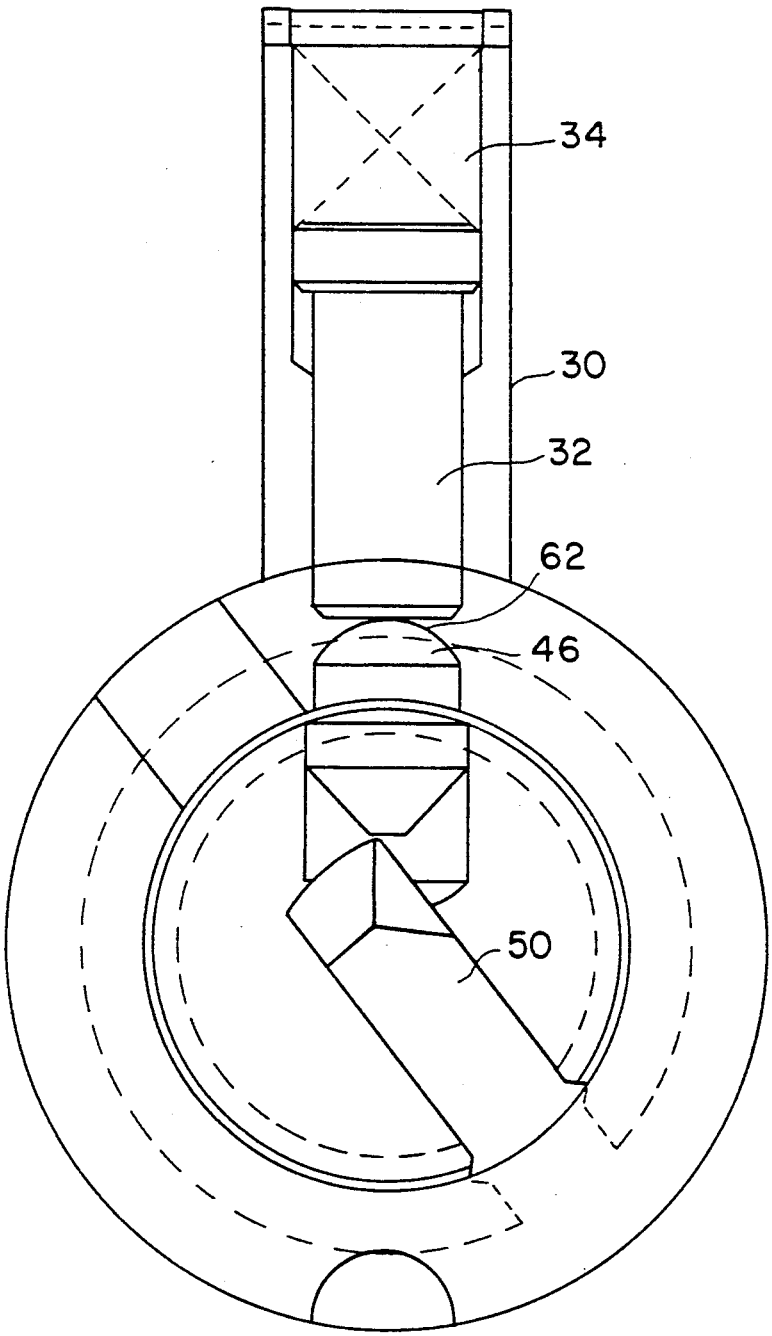
FIG. 7 is a view similar to FIG. 6 depicting the lock with a control key activated to permit release of the cylinder lock core.
Figure 8:
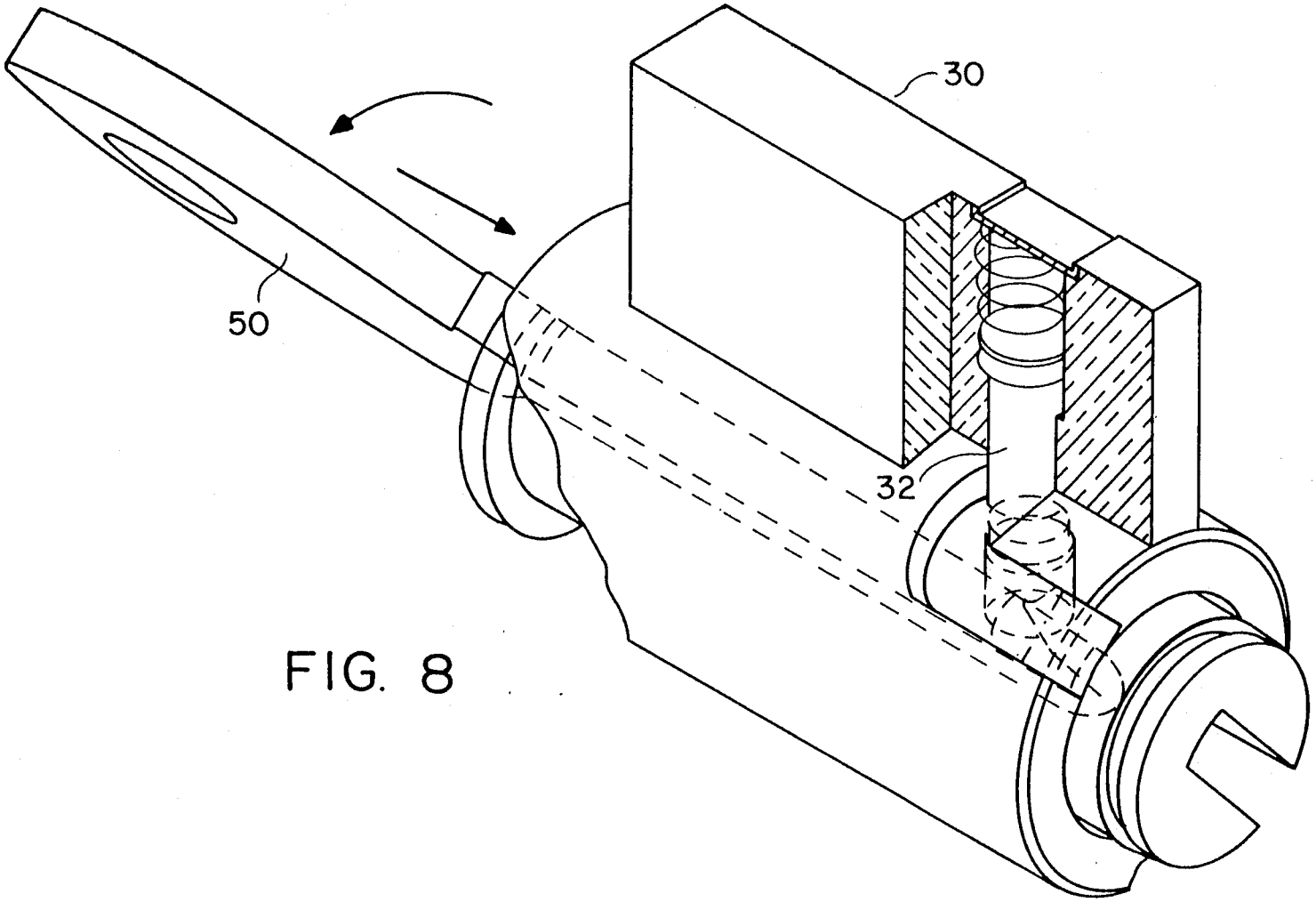
FIG. 8 is a perspective view of the operating condition of FIG. 7.

A control key for the use with the locking system of FIGS. 1-4 is schematically indicated at 50 in FIG. 5. The control key will include the same bitting as an operating key but such bitting will be elongated. Additionally, the blade 52 of control key 50 will be elongated such that a bitting formed at or adjacent the tip thereof, as indicated at 54, will be capable of contacting the bottom pin 46 of the pin tumbler stack which includes driver/retainer pin 32. In order to employ the control key, the key will be inserted to the point where the bitting on the blade thereof operates the conventional pin tumblers, thus permitting rotation of the plug relative to the shell to the position shown in FIG. 6 where the bottom pin 46 will be in abutting relationship to the driver/retainer pin 32. At this time, as depicted in FIG. 7, the control key is pushed further into the keyway thus causing the bitting 54 to cam bottom pin 46 outwardly with respect to the axis of rotation of plug 28 as shown in FIGS. 7 and 8. This camming action repositions the shear line between driver/retainer pin 32 and bottom pin 46 such that it is disposed outwardly with respect to its normal position (shown in FIG. 6).

Figure 9:
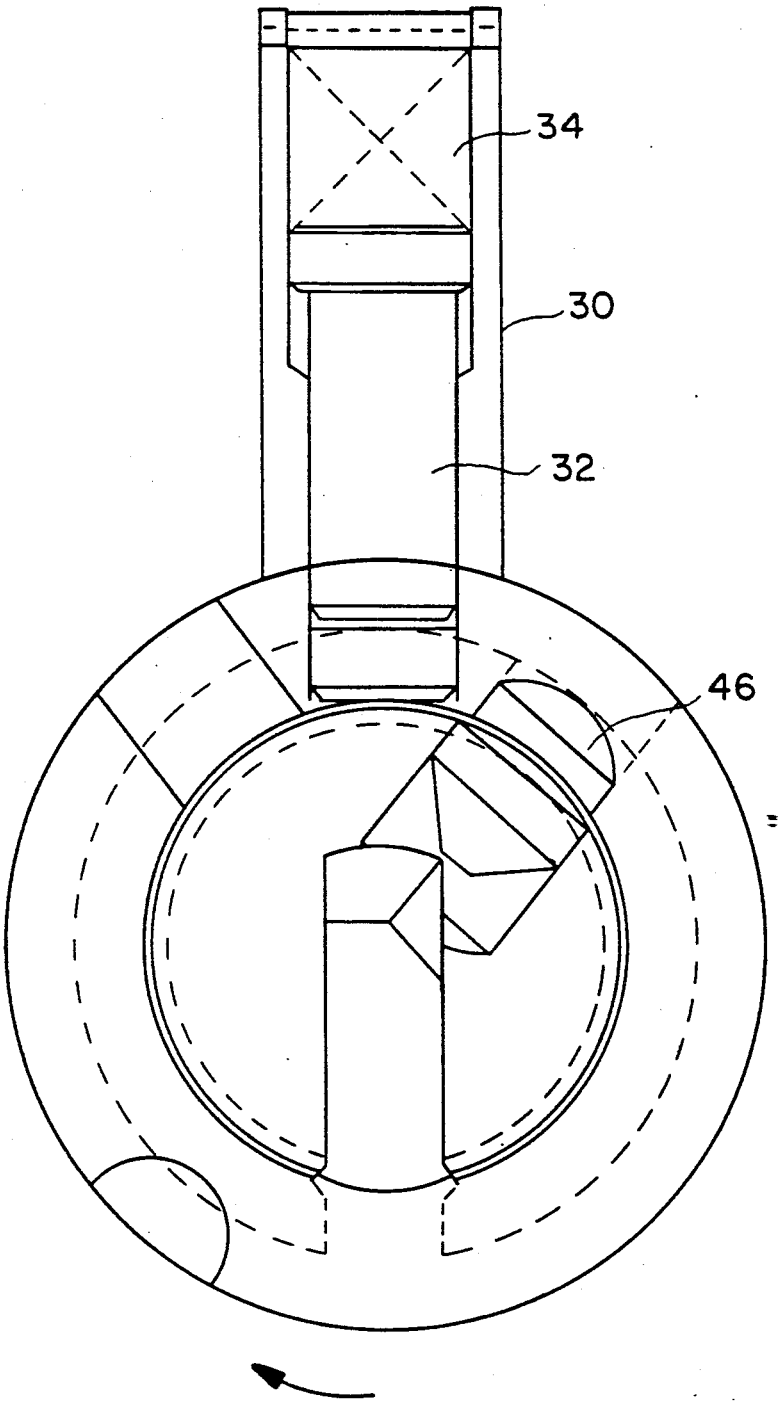
FIG. 9 is a cross-sectional view similar to FIG. 7, but with a control key rotated to the position which enables removal of the core.
Figure 10:
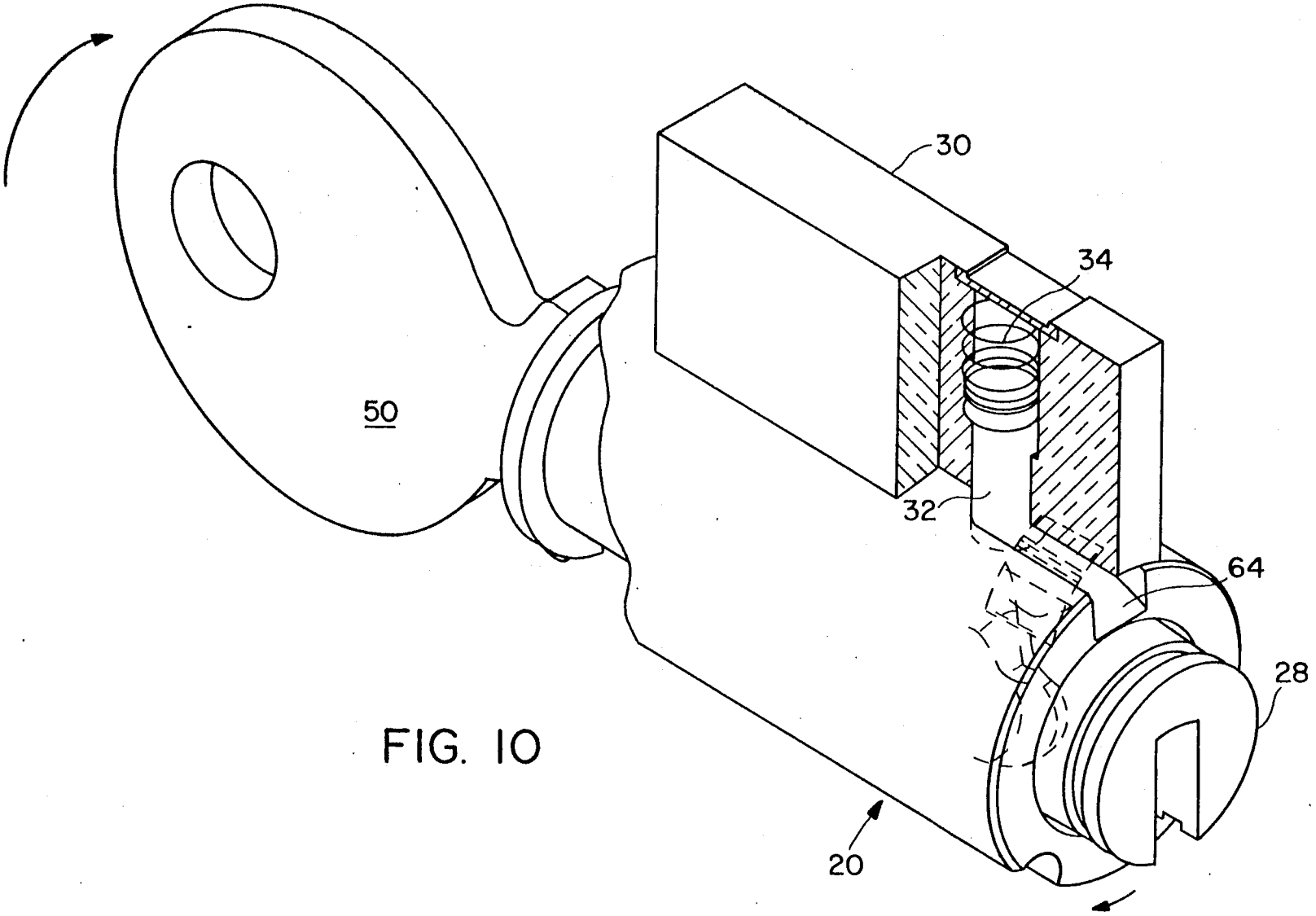
FIG. 10 is a perspective view similar to FIG. 8, showing the lock in the condition depicted in FIG. 9.
Figure 11:
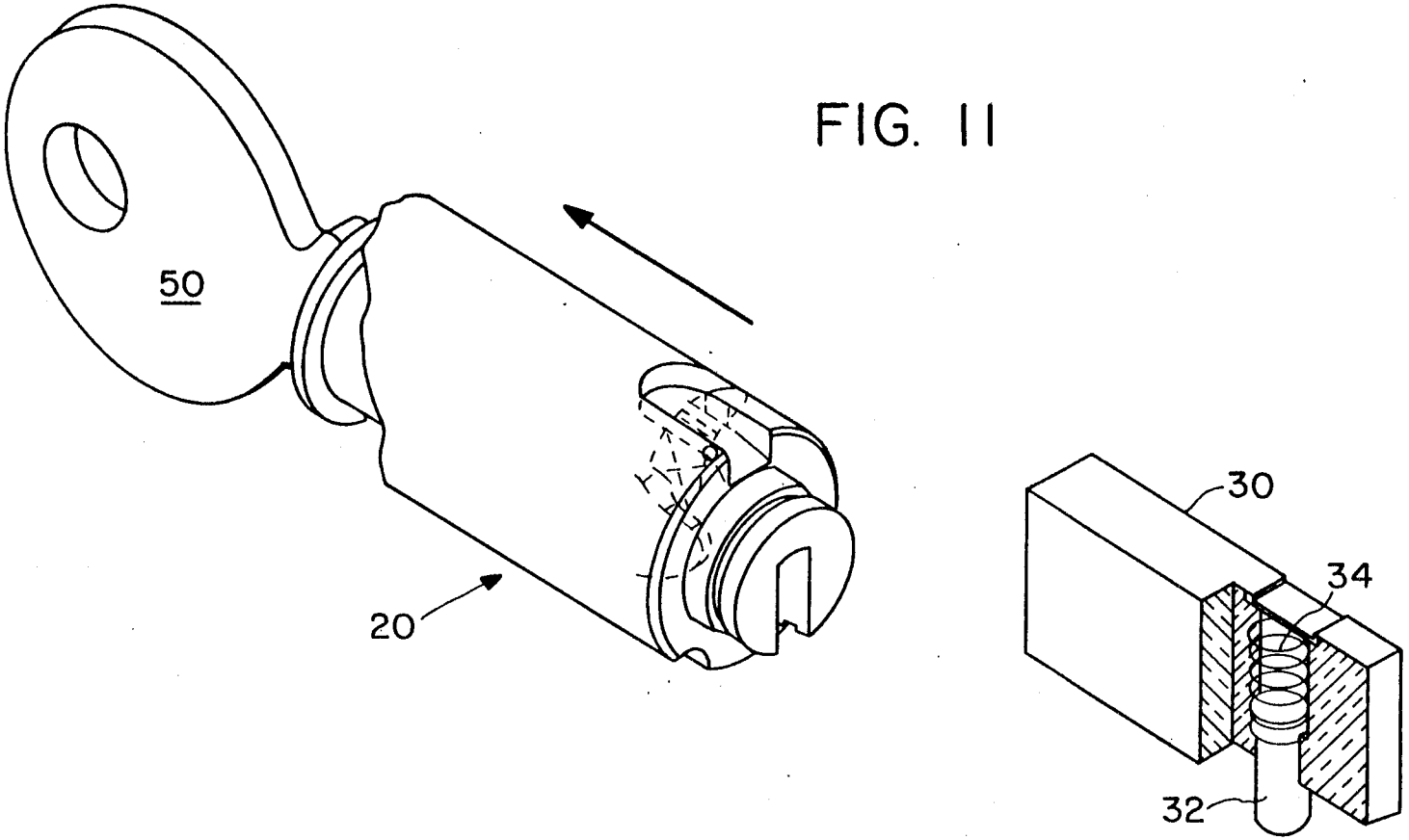
FIG. 11 is a view similar to FIG. 10 depicting removal of the core.

As best seen from FIG. 1, in the disclosed embodiment shell 36 and sleeve 37 are provided with a generally L-shaped groove 60 which extends generally circumferentially and then axially from bore 42 to the end of the cylinder lock 20 which is disposed oppositely to the entrance end of keyway 38. The intersection of groove 60 with bore 42 defines a second shear line 62 having a greater radius than shear line 39. When the shear line defined by the abutting faces of pins 32 and 46 coincides with shear line 62, as shown in FIGS. 7 and 8, the control key 50 can be turned so to cause the entire cylinder lock 20 to rotate relative to spindle 12, driver/-retainer pin 32 travelling in groove 60 during this relative rotation. This places the locking system in the condition depicted in FIGS. 9 and 10. At this time, as represented by FIG. 11, the cylinder lock 20 can be removed simply by pulling the control key 50 outwardly.

A new cylinder lock 20 may be installed by following the above-described steps in the reverse order. It is to be noted that the axially extended portion of slot 60 is provided with a ramp 64 which cooperates with driver/retainer pin 32 to cam this pin outwardly, thus compressing spring 34, when pin 32 enters the groove 60 during installation of a new core.

Referring to FIG. 12, the false bible 30 is externally configured to meet the operating environment and thus may take various forms. The inwardly disposed end of bible 30 will typically be shaped to securely engage a chassis member and, in the disclosed embodiment, this is accomplished by use of the retaining flange plate 70 and by provision of the lower bible portion of tapered shape. Accordingly, the bible 30 will be supported adjacent the core, i.e., cylinder lock 20, with the retainer pin receiving chamber therein aligned with the bore 42 in shell 36 when the core is installed.

Referring to FIG. 13, a key 50' for use with a lock as shown in U.S. Pat. No. 4,823,575, modified to incorporate the present invention, is shown. The key of FIG. 13 is characterized, in addition to the retainer pin actuating tumbler bitting 54' adjacent the tip of the blade, with a spring loaded pin 80 which performs the function of the projection 90 of the patented key. Thus, and incorporating column 6, line 50 through column 7, line 15 of U.S. Pat. No. 4,823,575 by reference, the pin 80 is shaped at its tip, i.e., at the leading end thereof as the key is inserted into a keyway, so that the pin will cam an auxiliary pin tumbler stack outwardly. In the disclosed embodiment, the camming surface on pin 80 comprises a sloped surface which extends from the reduced diameter tip to the main body portion of the pin. Also, in order to ensure that the pin 80 does not "hang up" on the edge of a pin tumbler during key rotation, in the disclosed embodiment the pin is formed from round stock so that the side surface thereof may function as a camming surface regardless of the direction of key rotation.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A key for a cylinder lock comprising:

a bow;

a blade longitudinally extending from said bow to a tip, said blade comprising a pair of longitudinally extending oppositely disposed and spaced edges, said blade further comprising side faces which connect said edges, said edges being at least in part substantially parallel to one another, said blade being provided with surface irregularities which define bitting; and a projection extending outwardly from at least a first of said oppositely disposed edges, said projection being sized and shaped to enter a keyway with the blade and having a plurality of cam surfaces thereon, said projection being defined by a pin which extends outwardly from said bow along said first edge; and means for resiliently biasing said pin towards said blade tip.

2. The key of claim 1 wherein said pin has a substantially cylindrical shape and a tip of reduced diameter, said tip being coaxial with the pin and being disposed at the end of the pin which is disposed away from said bow, said pin having a tapered surface extending rearwardly from said tip, said tapered surface defining one of said cam surfaces, the side of said cylindrical pin forming another of said cam surfaces.

3. The key of claim 1 wherein said bitting is elongated to permit limited axial movement of the key in a keyway.

4. The key of claim 3 further comprising a control bitting adjacent said blade tip, said control bitting being operable only when the key is inserted into the keyway as far as permitted by said elongated bitting.

5. The key of claim 4 wherein said pin has a substantially cylindrical shape and a tip of reduced diameter, said tip being coaxial with the pin and being disposed at the end of the pin which is disposed away from said bow, said pin having a tapered surface extending rearwardly from said tip, said tapered surface defining one of said cam surfaces, the side of said cylindrical pin forming another of said cam surfaces.

* * * * *